US010059554B2

(12) United States Patent
Kamichi

(10) Patent No.: US 10,059,554 B2
(45) Date of Patent: Aug. 28, 2018

(54) SHEET CONVEYANCE DEVICE AND IMAGE FORMING APPARATUS INCORPORATING SAME

(71) Applicant: Junpei Kamichi, Tokyo (JP)

(72) Inventor: Junpei Kamichi, Tokyo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 15/481,774

(22) Filed: Apr. 7, 2017

(65) Prior Publication Data

US 2017/0320687 A1 Nov. 9, 2017

(30) Foreign Application Priority Data

May 9, 2016 (JP) ..... 2016-093803
Mar. 2, 2017 (JP) ..... 2017-039847

(51) Int. Cl.
*B65H 29/20* (2006.01)

(52) U.S. Cl.
CPC ..... *B65H 29/20* (2013.01); *B65H 2301/3332* (2013.01); *B65H 2301/512565* (2013.01); *B65H 2402/441* (2013.01); *B65H 2402/443* (2013.01); *B65H 2601/11* (2013.01)

(58) Field of Classification Search
CPC ..... B65H 2601/11; B65H 2601/111; B65H 29/20; B65H 2301/3332; B65H 2301/512565; B65H 2402/441; B65H 2402/443
See application file for complete search history.

(56) References Cited

U.S. PATENT DOCUMENTS 6,427,744 B2 * 8/2002 Seki ..... B65C 9/40 156/353
7,455,295 B2 * 11/2008 Marx ..... B65H 5/06 271/272
7,684,731 B2 * 3/2010 Hirose ..... B65H 5/00 399/124
7,789,388 B2 * 9/2010 Matsubara ..... B65H 29/58 271/186
8,989,651 B2 * 3/2015 Mori ..... G03G 15/6573 399/401
9,037,073 B2 * 5/2015 Aoyama ..... G03G 15/6529 399/392
9,323,206 B2 * 4/2016 Sato ..... G03G 15/6552
9,475,667 B2 * 10/2016 Kodama ..... B65H 29/125

FOREIGN PATENT DOCUMENTS

JP H08-146690 6/1996
JP 2005-138970 6/2005

* cited by examiner

*Primary Examiner* — Patrick Cicchino
(74) *Attorney, Agent, or Firm* — Harness, Dickey & Pierce, P.L.C.

(57) ABSTRACT

A sheet conveyance device includes a conveyance roller to convey a sheet, an ejection roller to eject the sheet from the sheet conveyance device, a conveyance relay roller disposed between the conveyance roller and the ejection roller, a driven roller disposed in contact with the conveyance relay roller to form a nip, and an openable portion to open and close relative to a housing of the sheet conveyance device. A pivotable roller holder to pivot relative to openable portion is attached to the openable portion. The pivotable roller holder holds the conveyance relay roller and the driven roller to maintain a nip pressure between the conveyance relay roller and the driven roller when the openable portion is opened.

10 Claims, 5 Drawing Sheets

SHEET CONVEYANCE DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2016-093803, filed on May 9, 2016, and 2017-039847, filed on Mar. 2, 2017, in the Japan Patent Office, the entire disclosure of each of which is hereby incorporated by reference herein.

BACKGROUND

Technical Field

Embodiments of this disclosure generally relate to a sheet conveyance device and an image forming apparatus, such as a copier, a printer, a facsimile machine, or a multifunction peripheral having at least two of copying, printing, facsimile transmission, plotting, and scanning capabilities, that includes the sheet conveyance device.

Description of the Related Art

There are sheet conveyance devices including an ejection roller to eject the sheet from the sheet conveyance device and a conveyance relay roller disposed between a fixing device and the ejection roller. Such a sheet conveyance device further includes an openable portion (e.g., an openable cover) to open and close relative to a housing of the sheet conveyance device.

SUMMARY

An embodiment of the present invention provides a sheet conveyance device that includes a conveyance roller to convey a sheet, an ejection roller to eject the sheet from the sheet conveyance device, a conveyance relay roller disposed between the conveyance roller and the ejection roller, a driven roller disposed in contact with the conveyance relay roller to form a nip, and an openable portion to open and close relative to a housing of the sheet conveyance device. Further, a pivotable roller holder is attached to the openable portion. The pivotable roller holder is to pivot relative to openable portion and holds the conveyance relay roller and the driven roller so that a nip pressure between the conveyance relay roller and the driven roller is maintained when the openable portion is opened.

In another embodiment, an image forming apparatus includes an image forming device to form an image on a sheet and the sheet conveyance device described above.

Yet another embodiment provides a sheet conveyance device that includes the conveyance roller, the ejection roller, and the conveyance relay roller described above. The sheet conveyance device further includes a driven roller disposed in contact with the conveyance relay roller to form a nip and an opposing roller disposed in contact with the ejection roller to form an ejection nip. The nip pressure between the conveyance relay roller and the driven roller is weaker than a nip pressure of the ejection nip.

In yet another embodiment, an image forming apparatus includes an image forming device to form an image on a sheet and the sheet conveyance device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
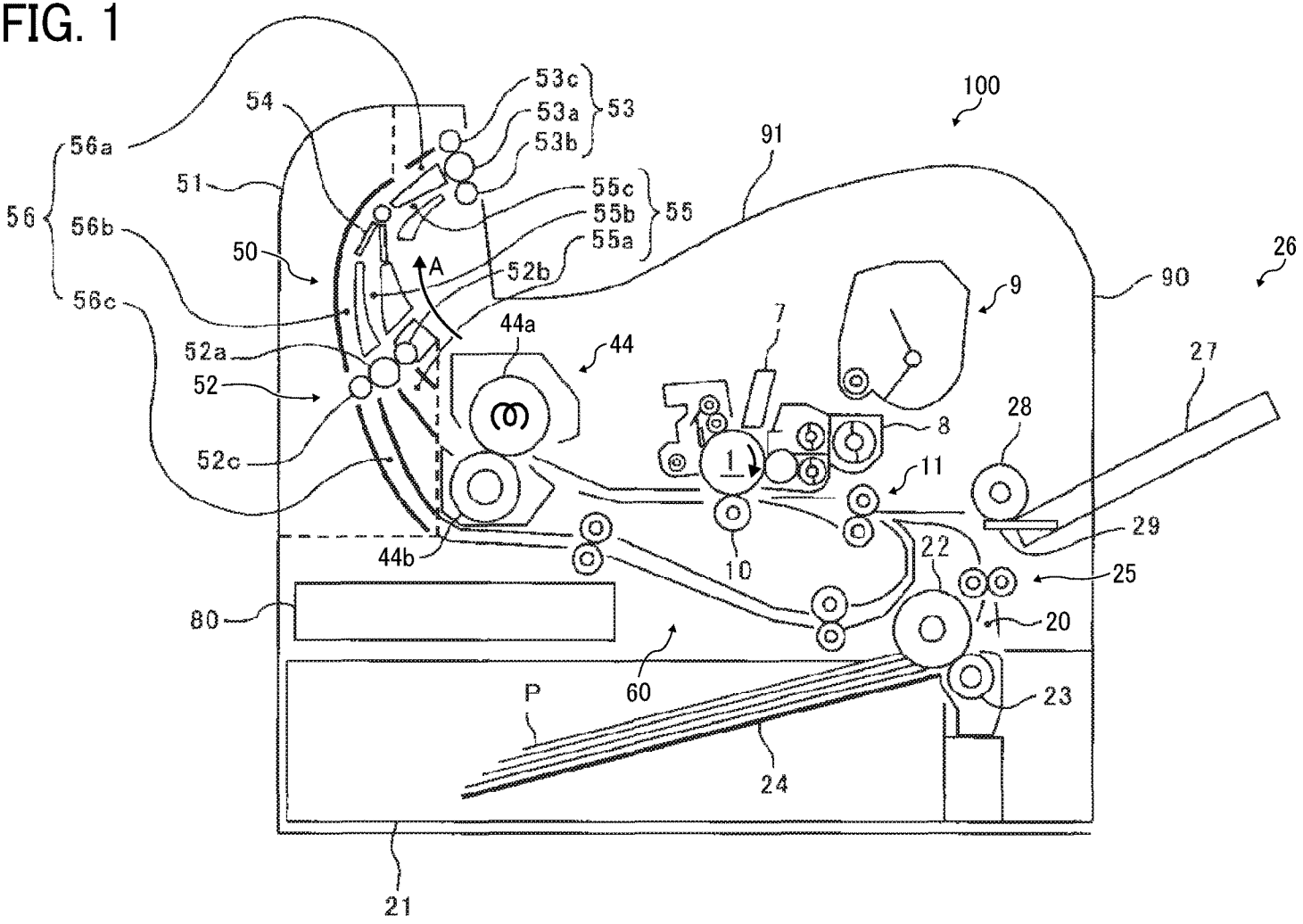
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

Descriptions are given below of an electrophotographic printer as an example of an image forming apparatus including a sheet conveyance device, which is provided with a reverse passage, according to an embodiment.

A basic configuration of an image forming apparatus 100, which in the present embodiment is a printer, for example, is described below.

Figure 2:
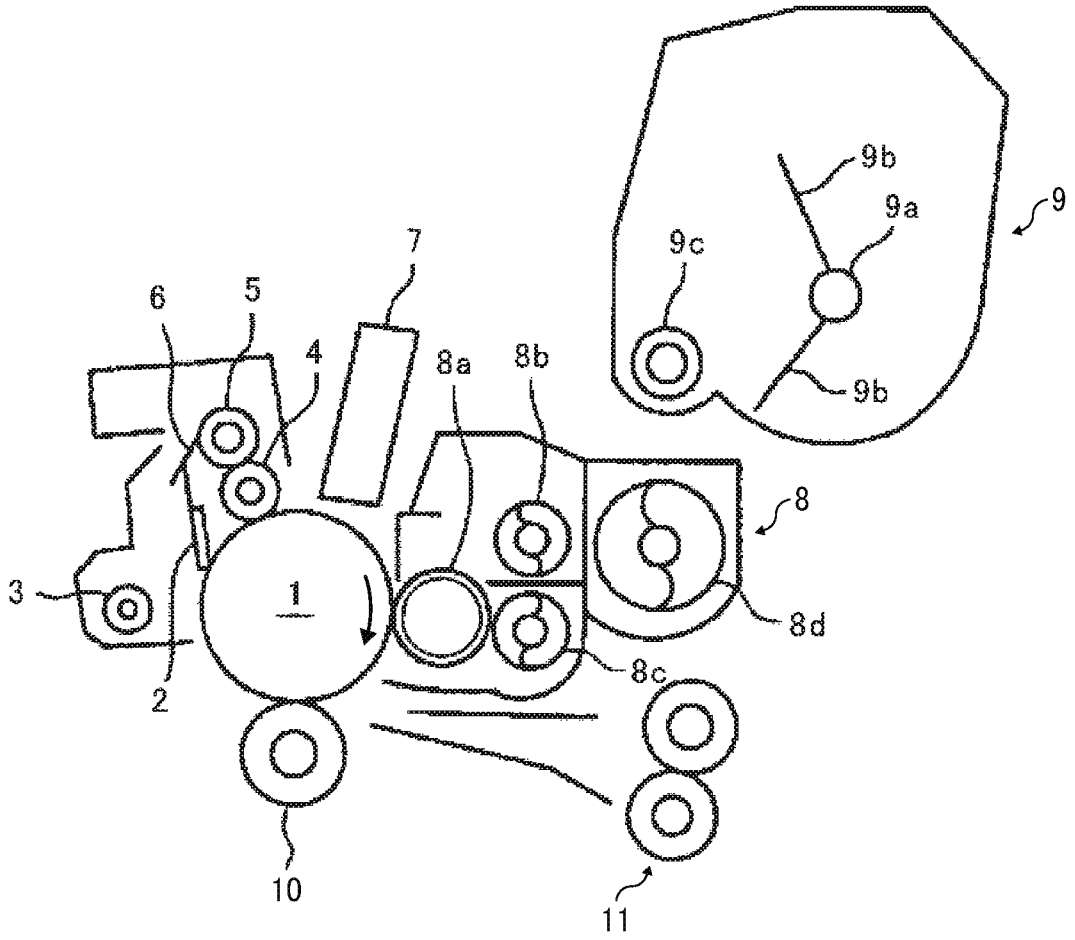
FIG. 2 is an enlarged schematic view of a photoconductor and adjacent components included in the image forming apparatus illustrated in FIG. 1.

FIG. 1 is a schematic diagram of the image forming apparatus 100 according to the present embodiment. FIG. 2 is an enlarged, schematic cross-sectional view of a photoconductor 1 and adjacent components in the image forming apparatus illustrated in FIG. 1.

As illustrated in FIG. 1, the image forming apparatus 100 includes the photoconductor 1, serving as a latent image bearer, and a sheet tray 21. The sheet tray 21 serves as a sheet container that is removably mounted in an apparatus housing 90 of the image forming apparatus 100. The sheet tray 21 includes a bottom plate 24 and contains a plurality of sheets P, as recording media, stacked on the bottom plate 24.

The image forming apparatus 100 further includes a feeding roller 22 and a separation roller 23. As the feeding roller 22 rotates, the sheet P is sent out from the sheet tray 21. After passing through a nip between the feeding roller 22 and the separation roller 23, the sheet P enters a sheet feeding path 20. Then, a conveyance roller pair 25 nips the sheet P therein and conveys the sheet P in the sheet feeding path 20 in a sheet conveyance direction. At an end of the sheet feeding path 20, a registration roller pair 11 is disposed. When a leading end of the sheet P is nipped in the registration roller pair 11, the conveyance roller pair 25 stops rotating, thereby suspending the conveyance of the sheet P. While the sheet P is thus nipped, the skew of the sheet P is corrected.

The registration roller pair 11 starts rotating to feed the sheet P to a transfer nip timely so that a toner image on the photoconductor 1 is transferred onto the sheet P in the transfer nip. At that time, the sheet P is nipped in the conveyance roller pair 25 as well. The registration roller pair 11 and the conveyance roller pair 25 start rotating simultaneously to resume the conveyance of the sheet P.

The apparatus housing 90 holds a bypass tray unit 26 (a side tray unit) including a sheet tray 27, a bypass feeding roller 28, and a separation pad 29. As the bypass feeding roller 28 rotates, the sheet P manually set on the sheet tray 27 is fed from the sheet tray 27. The separation pad 29 is disposed in contact with the bypass feeding roller 28, forming a separation nip. After passing through the separation nip between the bypass feeding roller 28 and the separation pad 29, the sheet P enters a region upstream from the registration roller pair 11 in the sheet feeding path 20 in the sheet conveyance direction. The sheet P passes the registration roller pair 11 and reaches the transfer nip similar to the sheet P fed form the sheet tray 21.

Referring to the enlarged view in FIG. 2, the photoconductor 1, which is drum-shaped, rotates clockwise in FIG. 2. Disposed around photoconductor 1 are a collecting screw 3, a cleaning blade 2, a charging roller 4, a latent image writing device 7, a developing device 8, and a transfer roller 10.

The charging roller 4 includes a conductive rubber roller body and rotates while contacting the photoconductor 1, thereby forming a charging nip. A power supply applies a charging bias to the charging roller 4. Thus, electrical discharge is induced in the charging nip, which is a micro gap between the photoconductor 1 and the charging roller 4. As a result, the surface of the photoconductor 1 is uniformly charged.

The latent image writing device 7 includes a light-emitting diode (LED) array and irradiates, with LED light, the uniformly charged surface of the photoconductor 1. Of the uniformly charged surface of the photoconductor 1, an irradiated portion is reduced in potential significantly. Thus, an electrostatic latent image is formed on the surface of the photoconductor 1.

As the photoconductor 1 rotates, the electrostatic latent image thereon is transported to a developing range opposite the developing device 8 and developed into a visible image (i.e., a toner image).

The developing device 8 includes a circulation portion and a developing portion. The circulation portion contains developer including toner and magnetic carrier. The circulation portion includes a first screw 8*b* to supply the developer to a developing roller 8*a* and a second screw 8*c* disposed beneath the first screw 8*b*. The second screw 8*c* collects the developer from the developing roller 8*a*. The circulation portion further includes an inclined screw 8*d* to send the developer from the second screw 8*c* to the first screw 8*b*.

The developing roller 8*a*, the first screw 8*b*, and the second screw 8*c* are parallel to each other. By contrast, the inclined screw 8*d* is inclined relative to the developing roller 8*a*, the first screw 8*b*, and the second screw 8*c*.

While rotating, the first screw 8*b* conveys the developer in a direction perpendicular to the surface of the paper on which FIG. 2 is drawn, specifically, from the backside to the front side of the paper on which FIG. 2 is drawn. At this time, the first screw 8*b* supplies a portion of the developer to the developing roller 8*a* disposed opposite the first screw 8*b*.

In an end portion on the front side of the paper on which FIG. 2 is drawn, the developer conveyed by the first screw 8*b* drops onto the second screw 8*c*.

The second screw 8*c* receives used developer (i.e., the developer that has passed through the developing range) from the developing roller 8*a* and conveys the used developer, in the direction from the back side toward the front side of the paper on which FIG. 2 is drawn, while rotating.

The developer is conveyed by the second screw 8*c* to an end portion on the front side of the paper on which FIG. 2 is drawn, where the developer is received by the inclined screw 8*d*.

While rotating, the inclined screw 8*d* conveys the developer, in the direction from the front side to the backside of the paper on which FIG. 2 is drawn, and forwards the developer to the first screw 8*b* in an end portion on the back side in the above-mentioned direction.

The developing roller 8*a* includes a rotatable developing sleeve and a magnet roller. The rotatable developing sleeve is a tubular-shaped and made of a nonmagnetic material. The magnet roller is disposed inside the developing sleeve not to rotate together with the developing sleeve.

A portion of the developer supplied by the first screw 8*b* is to the developing sleeve is borne on the surface of the developing sleeve by the magnetic force exerted by the magnet roller.

While the developer borne on the surface of the developing sleeve passes through a position facing a doctor blade, the layer thickness of the developer on the surface of the developing sleeve is regulated. Subsequently, the developer borne on the developing sleeve slidingly contacts the surface of the photoconductor 1 in the developing range opposing the photoconductor 1.

To the developing sleeve, a developing bias is applied. The developing bias is identical in polarity to the toner in developer and a background potential, meaning the potential of a background area (non-image area) of the photoconductor 1. The developing bias is greater in absolute value than a latent image potential (i.e., the potential of the irradiated area) and is smaller than the background potential. Therefore, in the developing range, a developing potential (a potential difference) acts between the developing sleeve and the electrostatic latent image on the photoconductor 1. The developing potential causes the toner to electrostatically move from the developing sleeve toward the latent image.

By contrast, a background potential (a potential difference) acts between the developing sleeve and the background area of the photoconductor 1 to electrostatically move the toner from the background portion toward the developing sleeve. With such actions, in the developing range, the toner adheres to the electrostatic latent image on the photoconductor 1, thus developing the electrostatic latent image.

As the developing sleeve rotates, the developer that has passed through the developing range enters a developer release area, where the developing sleeve faces the second screw 8*c*. In the developer release area, adjacent two magnetic poles, of a plurality of magnetic poles of the magnet roller, have an identical polarity to generate a repulsive magnetic field.

In the developer release area, with the effect of the repulsive magnetic field, the developer is separated from the surface of the developing sleeve and collected by the second screw 8*c*.

The second screw 8*c* conveys the collected developer to the inclined screw 8*d*. Since the toner in the developer is consumed in the developing range, the concentration of toner in the collected developer is reduced.

The developing device 8 further includes a toner concentration sensor to detect the concentration (e.g., percent by weight) of toner in the developer being conveyed by the inclined screw 8*d*.

A controller 80 illustrated in FIG. 1 is configured to output a toner supply signal, based on a detection result generated by the toner concentration sensor. The toner supply signal instructs supply of toner from the toner cartridge 9 to the developer being conveyed by the inclined screw 8*d*.

As illustrated in FIGS. 1 and 2, the toner cartridge 9 is disposed above the developing device 8.

The toner cartridge 9 includes a rotation shaft 9*a*, an agitator 9*b* secured to the rotation shaft 9*a*, and a toner supply member, such as a sponge roller. The agitator 9*b* conveys the toner in the toner cartridge 9 toward the toner supply member 9*c*. According to the toner supply signal output from the controller 80, the toner supply member 9*c* rotates, thereby supplying an amount of toner corresponding to the amount of rotation of the toner supply member 9*c* to the inclined screw 8*d* of the developing device 8.

The toner image, which has been developed on the photoconductor 1 by the developing device 8, enters the transfer nip, where the photoconductor 1 contacts the transfer roller 10 that functions as a transfer device, as the photoconductor 1 rotates. To the transfer roller 10, a transfer bias in the polarity opposite the polarity of the latent image potential of the photoconductor 1 is applied, and thus a transfer electric field is generated in the transfer nip.

As described above, the registration roller pair 11 conveys the sheet P toward the transfer nip, timed to coincide with the arrival of the toner image on the photoconductor 1 at the transfer nip. In the transfer nip, the sheet P tightly contacts the toner image, and the toner image is transferred from the photoconductor 1 onto the sheet P with effects of the transfer electrical field and the nip pressure.

A certain amount of toner tends to remain untransferred on the photoconductor 1 that has passed through the transfer nip. The cleaning blade 2, which is in contact with the photoconductor 1, scrapes off the residual toner from the surface of the photoconductor 1. As the collecting screw 3 rotates, the residual toner is discharged outside of a unit casing. The toner discharged from the unit casing is conveyed to a waste-toner bottle.

After the cleaning blade 2 cleans the surface of the photoconductor 1, a discharger removes electric charge from the surface of the photoconductor 1, after which the charging roller 4 again charges the surface of the photoconductor 1 uniformly.

To the charging roller 4 disposed in contact with the surface of the photoconductor 1, unwanted materials, such as toner additives and the toner not removed by the cleaning blade 2, adhere. The unwanted materials are transferred to a cleaning roller 5 disposed in contact with the charging roller 4. A scraper 6 disposed in contact with the cleaning roller 5 scrapes off the unwanted materials from the surface of the cleaning roller 5. The unwanted materials drop to the collecting screw 3 disposed below the scraper 6.

The sheet P that has passed through the transfer nip, where the photoconductor 1 contacts the transfer roller 10, is transported to a fixing device 44.

Figure 4A:
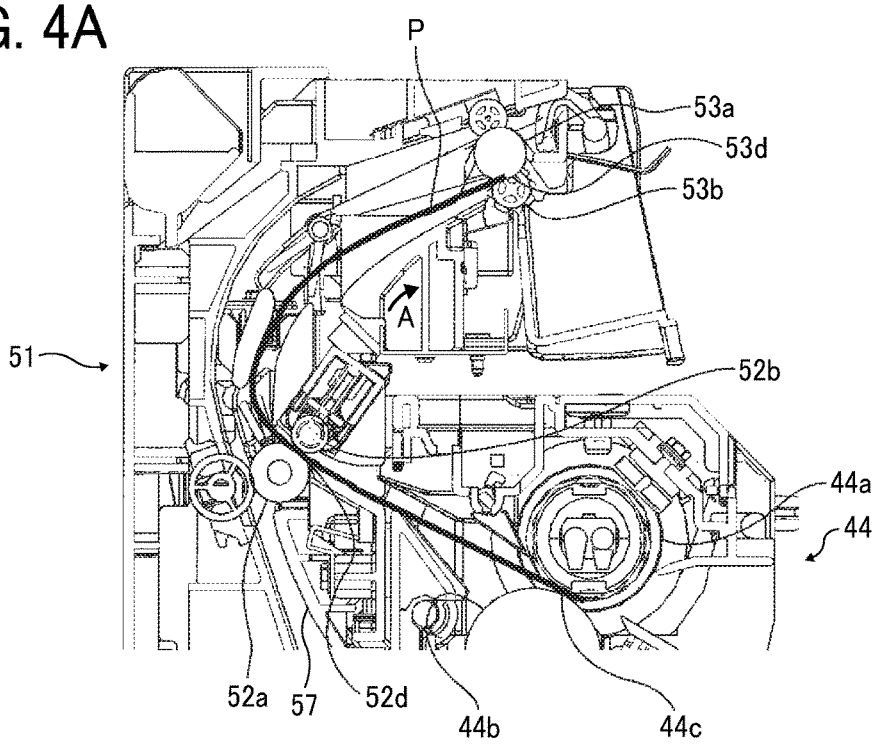
FIG. 4A is a cross-sectional view of the ejection and reverse path illustrated in FIG. 3A, with a sheet jammed in a sheet ejection path.
Figure 4B:
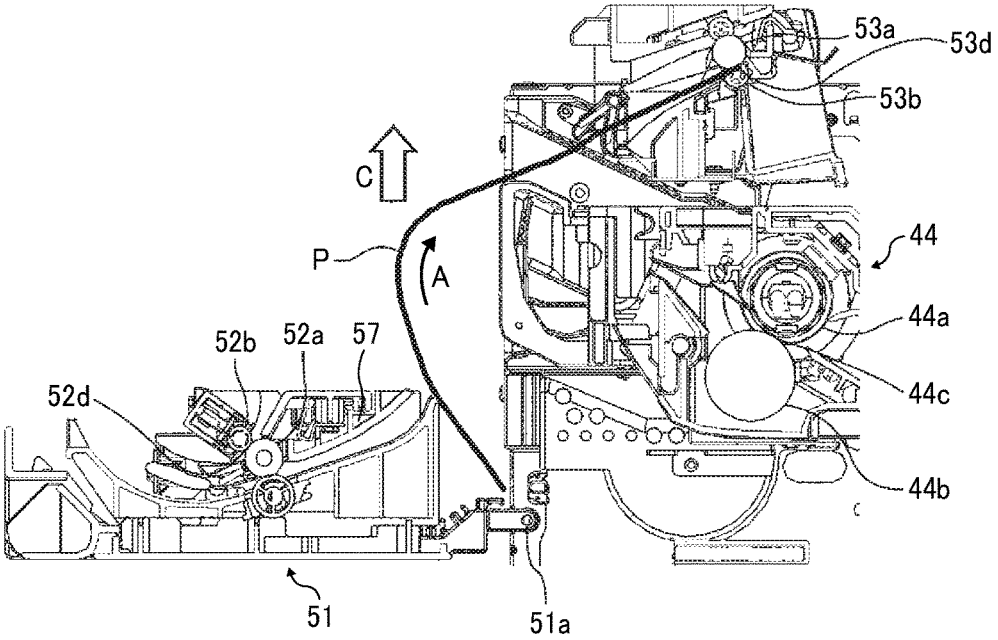
FIG. 4B is a cross-sectional view of the ejection and reverse path illustrated in FIG. 4A, in a state in which the rear cover is closed.

The fixing device 44 includes a fixing roller 44*a* and a pressure roller 44*b* pressed against the fixing roller 44*a*, thereby forming a fixing nip 44*c* (illustrated in FIGS. 4A and 4B). Inside the fixing roller 44*a*, a heat generating source such as a halogen lamp is disposed.

The toner image on the surface of the sheet P is fixed with heat and pressure while the sheet P is nipped in the fixing nip P.

Referring to FIG. 1, in the image forming apparatus 100 according to the present embodiment, an ejection and reverse path 50 is disposed downstream from the fixing device 44 in the sheet conveyance direction, indicated by arrow A. The ejection and reverse path 50 includes a sheet ejection path 55 and a sheet reverse path 56. The sheet ejection path 55 is to guide the sheet P to a sheet stack section 91 outside the apparatus housing 90 and on an upper side of the apparatus housing 90. The direction indicated by arrow A, trending from the fixing device 44 to the sheet stack section 91, is also referred to as an ejection direction. The sheet reverse path 56 is to reverse (switchback) the sheet P and guide the sheet P to a re-feeding path 60. The sheet ejection path 55 includes a first ejection path 55*a*, a second ejection path 55*b*, and a third ejection path 55*c*. The sheet reverse path 56 includes a first reverse path 56*a*, a second reverse path 56*b*, and a third reverse path 56*c*. Between the second ejection path 55*b* and the third ejection path 55*c*, a switching pawl 54 is disposed rotatably. The paths for sheet conveyance can be defined by guide members (e.g., guide plates) and outer faces of devices.

The image forming apparatus 100 according to the present embodiment, illustrated in FIG. 1, is capable of switching between single-side printing to form an image on one side of the sheet P and double-side printing to form images on both sides of the sheet P.

In a state in which an image has been formed on one side of the sheet P in single-side printing, or in a state in which images have been formed on both sides of the sheet P in double-side printing, the sheet P ejected from the fixing device 44 is transported through the sheet ejection path 55, which includes the first ejection path 55*a*, the second ejection path 55*b*, and the third ejection path 55*c* and disposed downstream from the fixing device 44 in the sheet conveyance direction indicated by arrow A (hereinafter referred to as the sheet conveyance direction A). A section around a sheet outlet is referred to as a an ejection and reverse roller section 53, which includes an ejection roller 53*a* to rotate in a direction to eject the sheet P and an ejection roller 53*b* disposed facing the ejection roller 53*a*. The sheet P is conveyed through the nip between the ejection roller 53*a* and the ejection roller 53*a* and discharged outside the apparatus housing 90. The sheet P is stacked on the sheet stack section 91 located on the upper side of the apparatus housing 90.

At that time, the switching pawl 54 disposed between the second ejection path 55*b* and the third ejection path 55*c* rotates in a direction to guide the sheet P to the third ejection path 55*c*. That is, the switching pawl 54 opens an entrance of the third ejection path 55*c* and closes an entrance of the first reverse path 56*a*.

By contrast, in double-side printing, in a state in which an image has been formed on one side of the sheet P, the sheet P is transported to the first ejection path 55*a* and the second ejection path 55*b* located downstream from the fixing device 44 in the sheet conveyance direction A.

At that time, the switching pawl 54 is positioned to guide the sheet P to the first reverse path 56*a*. That is, the switching pawl 54 opens the entrance of the first reverse path 56*a* and closes the entrance of the third ejection path 55*c*. The first reverse path 56*a* is provided with a reverse roller 53*c* disposed facing the ejection roller 53*a*. The sheet P guided by the switching pawl 54 to the first reverse path 56*a* passes through the nip between the ejection roller 53*a* and the reverse roller 53*c*. The ejection roller 53*a*, the ejection roller 53*b*, and the reverse roller 53*c* together serve as an ejection and reverse roller section 53. The ejection roller 53*a* rotates in the ejection direction at least until the trailing end of the sheet P passes by the switching pawl 54, thereby temporarily ejects the leading end of the sheet P from the apparatus housing 90 to the sheet stack section 91. Before the trailing end of the sheet P exits the nip between the ejection roller 53*a* and the reverse roller 53*c*, the ejection roller 53*a* rotates in a sheet reverse direction, indicated by arrow B, opposite the ejection direction, to switchback the sheet P.

In a period from when the trailing end of the sheet P passes by the switching pawl 54 and to when the ejection roller 53*a* rotates in reverse, the switching pawl 54 rotates in a direction to guide the sheet P to the second reverse path 56*b*. That is, the switching pawl 54 opens en exit of the second reverse path 56*b* and closes an exit of the second ejection path 55*b*.

The switchbacked sheet P is transported through the first reverse path 56*a*, the second reverse path 56*b*, and the third reverse path 56*c* and fed to the re-feeding path 60. Thus, in double-side printing, the sheet reverse path 56, which includes the first reverse path 56*a*, the second reverse path 56*b*, and the third reverse path 56*c*, is used to reverse the sheet P.

Figure 3A:
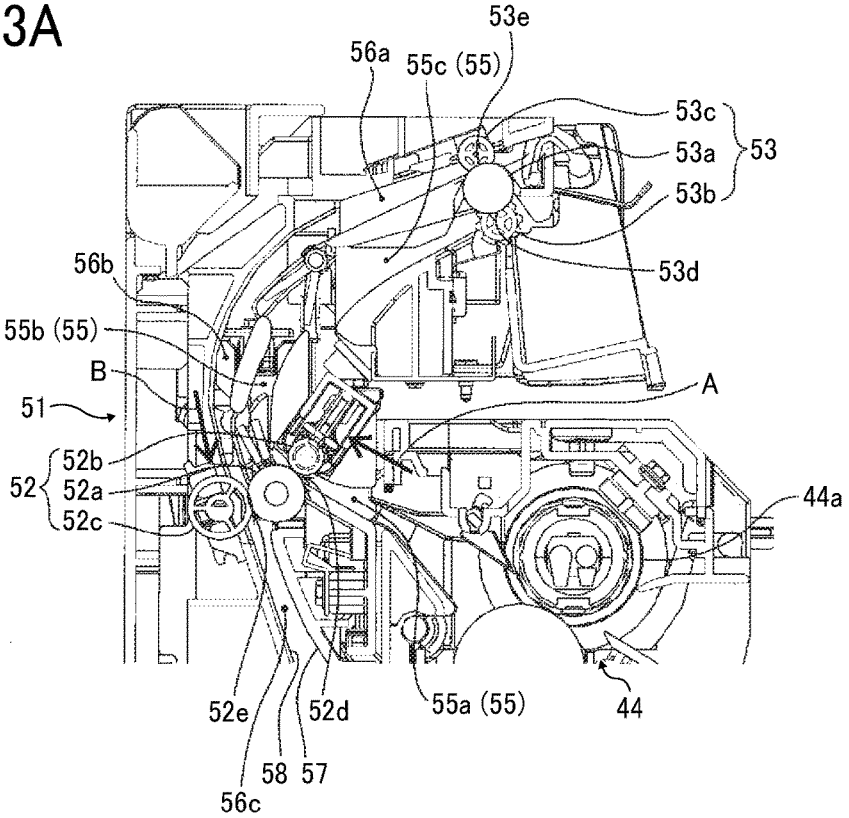
FIG. 3A is a cross-sectional view of a portion of the image forming apparatus illustrated in FIG. 1, including a fixing device and an ejection and reverse path, in a state in which a rear cover is open.
Figure 3B:
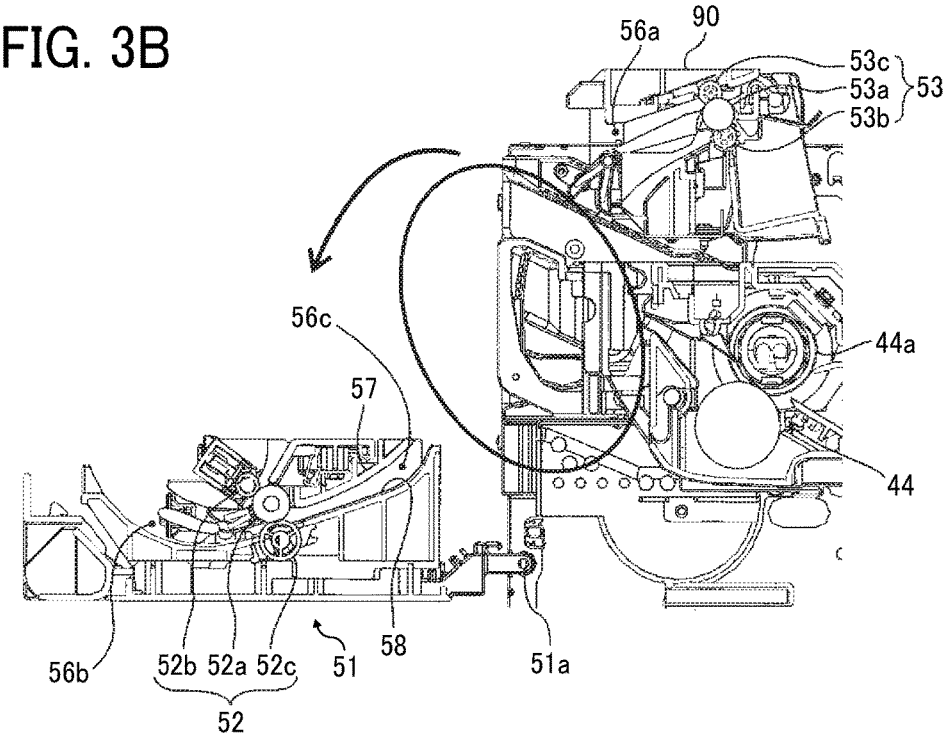
FIG. 3B is a cross-sectional view of the fixing device and the ejection and reverse path in a state in which the rear cover is closed.

FIGS. 3A and 3B are cross-sectional views of the ejection and reverse path 50 for the sheet P transported form the fixing device 44. FIG. 3A illustrates a state in which a rear cover 51, disposed on a rear side of the apparatus (opposite a front side on which a control panel is disposed), is open. FIG. 3B illustrates a state in which the rear cover 51 is closed. Thus, the rear cover 51 serves an openable cover to open and close relative to an apparatus housing. Although the rear cover 51 is described as the openable cover in the present embodiment, the openable cover can be disposed on a side or the front side of the apparatus, depending on the apparatus design.

As illustrated in FIG. 3B, the rear cover 51, serving as the openable cover, is pivotably attached to a support shaft 51*a* disposed in a lower portion of the apparatus housing 90. The rear cover 51 includes a pivotable front guide plate 57 serving as a pivotable roller holder and a rear guide plate 58. The pivotable front guide plate 57 and the rear guide plate 58 serve as sheet guides defining the conveyance path for the sheet P.

As illustrated in FIG. 3A, the ejection roller 53*a* is used for both of sheet ejection and sheet reverse. When attention is given to the sheet ejection path 55, the ejection roller 53*a* is disposed on the downstream side of the third ejection path 55*c* (a portion of the sheet ejection path 55) in the sheet conveyance direction A. The ejection roller 53*b* used to eject the sheet P is disposed in contact with the ejection roller 53*a*, thus forming a sheet ejection nip 53*d*.

By contrast, when attention is given to the sheet reverse path 56, the ejection roller 53*a* is on the upstream side (on a side of the sheet stack section 91) of the first reverse path 56*a* in the direction indicated by arrow B. The first reverse path 56*a* is a portion of the sheet reverse path 56. The reverse roller 53*c* used to reverse the sheet P is disposed in contact with the ejection roller 53*a*, thus forming a sheet reverse nip 53*e*. The ejection roller 53*a*, the ejection roller 53*b*, and the reverse roller 53*c* together serve as the ejection and reverse roller section 53.

As illustrated in FIG. 3A, a conveyance relay roller 52*a* is disposed next to the fixing roller 44*a*, which fixes the toner image on the sheet P while conveying the sheet P. Thus, the fixing roller 44*a* serves as a conveyance roller. The conveyance relay roller 52*a* is disposed between the two conveyance paths, namely, the sheet ejection path 55 leading from the fixing roller 44*a* to the ejection roller 53*a* and the sheet reverse path 56 leading form the ejection roller 53*a* to the re-feeding path 60. The conveyance relay roller 52*a* is used for the conveyance in the sheet ejection path 55 as well as in the sheet reverse path 56. A section including the conveyance relay roller 52*a*, an ejection-side relay roller 52*b*, and a reverse relay roller 52*c* is referred to as a conveyance relay roller section 52. Note that each of the fixing roller 44*a*, the conveyance relay roller 52*a*, and the ejection roller 53*a* is a conveyance roller to convey the sheet P with another roller in a pair.

The ejection-side relay roller 52*b* is disposed abutting on or in contact with the conveyance relay roller 52*a*, forming an ejection-side relay nip 52*d*. The ejection-side relay roller 52*b* serves as a driven roller used to convey the sheet P in the sheet conveyance direction A trending from the fixing roller 44*a* toward the ejection roller 53*a*. The sheet P that has just exited the fixing device 44 is immediately nipped in the ejection-side relay nip 52*d*, and the conveyance relay roller 52*a* conveys the sheet P in the sheet conveyance direction A illustrated in FIG. 3 to stabilize the conveyance of the sheet P. As the conveyance of the sheet P is stabilized, the fixing performance of the fixing device 44 is stabilized to obtain a fixed image with desirable quality.

Further, the reverse relay roller 52*c* is disposed abutting on or in contact with the conveyance relay roller 52*a*, forming a reverse relay nip 52*e*. The reverse relay roller 52*c* serves as a second driven roller used to convey the sheet P in the direction indicated by arrow B, trending from the ejection roller 53*a* to the re-feeding path 60 illustrated in FIG. 1. The direction indicated by arrow B is hereinafter referred to as "reverse conveyance direction B".

The conveyance relay roller 52*a*, the ejection-side relay roller 52*b*, and the reverse relay roller 52*c* together serve as the conveyance relay roller section 52.

As illustrated in FIG. 3B, the pivotable front guide plate 57 is pivotably attached to the rear cover 51 serving as the openable cover, and the conveyance relay roller 52*a* is held by the pivotable front guide plate 57. Similarly, the ejection-side relay roller 52*b* is held by the pivotable front guide plate 57.

To reliably convey the sheet P immediately after the sheet is discharged from the fixing device 44 for a long time, the nip pressure of the ejection-side relay nip 52*d* is kept constant regardless of elapse of time. Accordingly, in the present embodiment, the pivotable front guide plate 57 holds the ejection-side relay roller 52*b* and the conveyance relay roller 52*a* so that the nip pressure of the ejection-side relay nip 52*d* is maintained even when the rear cover 51 is opened. When the ejection-side relay roller 52*b* and the conveyance relay roller 52*a* are held by an identical component (i.e., the pivotable front guide plate 57), backlash between components can be reduced compared with a case where the ejection-side relay roller 52*b* and the conveyance relay roller 52*a* are held by different components. When the pivotable front guide plate 57 holds the ejection-side relay roller 52*b* and the conveyance relay roller 52*a* to maintain the nip pressure of the ejection-side relay nip 52*d* even when the rear cover 51 is opened, fluctuations in the distance between the axis of the ejection-side relay roller 52*b* and the axis of the conveyance relay roller 52*a* can be suppressed, compared with a case where the ejection-side relay roller 52*b* and the conveyance relay roller 52*a* are held so that the nip pressure fluctuate.

With this structure, the nip pressure of the ejection-side relay nip 52*d* is kept constant regardless of elapse of time. Accordingly, the sheet P that has just exited the fixing device 44 is reliably conveyed by the conveyance relay roller 52*a* and the conveyance relay roller 52*a* for a ling time.

By contrast, in the sheet reverse path 56, differently from the sheet ejection path 55, fluctuations in the conveyance of the sheet P less affect the image forming process such as the fixing process. Accordingly, the necessity of keeping the nip pressure of the reverse relay nip 52*e* regardless of elapse of time is low, compared with the ejection-side relay nip 52*d*. Accordingly, the reverse relay roller 52*c* is held by the rear guide plate 58 secured to the rear cover 51, not the pivotable front guide plate 57 that holds the conveyance relay roller 52*a*. The pivotable front guide plate 57 is configured to pivot when the rear cover 51 is opened so that the nip pressure of the reverse relay nip 52*e* decreases. This structure facilitates removal of a jammed sheet from the sheet ejection path 55.

In the present embodiment, the following structure enables changes in the nip pressure of the reverse relay nip 52*e* in conjunction with opening and closing of the rear cover 51. Specifically, when the rear cover 51 is closed, as illustrated in FIG. 3A, the fixing device 44 determines the respective positions of the pivotable front guide plate 57 and the rear guide plate 58. Specifically, a positioning portion of the fixing device 44 pushes the pivotable front guide plate 57 toward the rear guide plate 58, thereby increasing the nip pressure of the reverse relay nip 52*e* to a pressure suitable for the conveyance of the sheet P. When the rear cover 51 is opened and the alignment between the pivotable front guide plate 57 and the rear guide plate 58 is canceled, the pivotable front guide plate 57 pivots relative to the rear guide plate 58, thereby reducing the nip pressure of the reverse relay nip 52*e*. In other words, in the present embodiment, the positioning portion of the fixing device 44 to set the relative positions of the pivotable front guide plate 57 and the rear guide plate 58 serves as a nip pressure changer. The nip pressure changer to change the nip pressure of the reverse relay nip 52*e* is not limited to the positioning portion of the fixing device 44 but can be any structure to push the pivotable front guide plate 57 (at least a side holding the conveyance relay roller 52*a* thereof) toward the rear guide plate 58 for a predetermined amount. In another embodiment, the position of the rear guide plate 58 is set by the pivotable front guide plate 57.

In the present embodiment, the fixing device 44 is a modular unit removable from the apparatus housing 90, and the position of the fixing device 44 is set relative to the apparatus housing 90.

Descriptions are given below of the state illustrated in FIG. 3B, in which the rear cover 51 (the openable cover) is open.

As illustrated in FIG. 3B, as the rear cover 51 is rotated to open for removal of jammed sheets, the conveyance relay roller section 52 rotates, together with the pivotable front guide plate 57 and the rear guide plate 58. Accordingly, a portion of the apparatus housing 90, enclosed with an oval in FIG. 3B, is opened. The opened portion includes the sheet ejection path 55, leading from the fixing device 44 to the ejection and reverse roller section 53, and the first reverse path 56*a*, whish is a portion of the sheet reverse path 56. The entrance of the re-feeding path 60 is opened similarly.

In this state, sheets jammed in the fixing device 44, the sheet ejection path 55, the first reverse path 56*a* of the sheet reverse path 56, and the re-feeding path 60 can be found easily, thus facilitating the removal of jammed sheets.

When the openable cover is open, the second reverse path 56*b* and the third reverse path 56*c* of the sheet reverse path 56 in the rear cover 51 are opened. Further, pressure between the rear guide plate 58 and the pivotable front guide plate 57 (the force to push the pivotable front guide plate 57 toward the rear guide plate 58) is released. Accordingly, the nip pressure of the reverse relay nip 52*e* is reduced, and a sheet jammed in the sheet reverse path 56 (the second ejection path 55*b* and the third ejection path 55*c*) can be removed easily.

Thus, in the ejection and reverse path 50 according to the present embodiment, jammed sheets can be removed easily from the sheet ejection path 55 as well as from the sheet reverse path 56.

The ejection and reverse path 50 according to the present embodiment is also advantageous in, in addition to the image forming apparatus 100 illustrated in FIG. 1, image forming apparatuses from which the fixing device is not easily removed and image forming apparatuses in which space for removal of jammed sheets is small. In the case of image forming apparatuses dedicated for small sheet sizes, in which the largest sheet size is A4 size or smaller, the space for removal of jammed sheets is small.

That is, the pivotable front guide plate 57 holds the conveyance relay roller 52*a* and the ejection-side relay roller 52*b* disposed between the fixing roller 44*a* and the ejection roller 53*a*, and the pivotable front guide plate 57 is pivotably attached to the rear cover 51 to open and close relative to the apparatus housing 90. The conveyance relay roller 52*a* and the ejection-side relay roller 52*b* serves as a roller pair at (or adjacent to) the exit of the fixing device 44. With this structure, when the rear cover 51 is opened, the sheet jammed in a portion downstream from the fixing device 44 in the sheet conveyance direction A can be found easily. The jammed sheet can be removed without removing the fixing device 44.

Further, the pivotable front guide plate 57 (see FIGS. 3A and 3B) of the rear cover 51 holds the conveyance relay roller 52*a* and the ejection-side relay roller 52*b*, the roller pair at the exit of the fixing device 44, and the rear guide plate 58 of the rear cover 51 holds the reverse relay roller 52*c*. With this structure, when the rear cover 51 is opened, the pressure between the conveyance relay roller 52*a* and the reverse relay roller 52*c* is reduced. Accordingly, in the sheet reverse path 56, a strong pressure is not applied to the jammed sheet, and the jammed sheet can be removed from the conveyance relay roller 52*a*.

Descriptions are given below of sheet jam in the ejection and reverse path 50.

A comparative sheet conveyance device includes a stationary sheet guide and a pivotable sheet guide, to guide the sheet conveyed from the fixing device to a re-feed device. The pivotable sheet guide may be pivoted in conjunction with opening of the openable portion to expose the sheet conveyance path defined between the stationary sheet guide and the pivotable sheet guide, for removal of jammed sheet from the sheet conveyance path between the fixing device and the re-feed device.

FIGS. 4A and 4B are cross-sectional views of the ejection and reverse path 50 according to the present embodiment, indicating the positions of sheet jam. FIG. 4A illustrates a state in which the rear cover 51, disposed on a rear side of the apparatus (opposite a front side on which a control panel is disposed), is open. FIG. 4B illustrates a state in which the rear cover 51 is closed.

As illustrated in FIG. 4A, in the case of sheet jam in the sheet ejection path 55, the sheet P is held (nipped) by the pair of the fixing roller 44*a* and the pressure roller, the pair of conveyance relay roller 52*a* and the ejection-side relay roller 52*b*, and the pair of ejection roller 53*a* and the ejection roller 53*b*. Note that, in the case of a small sheet size that is short in the sheet conveyance direction A, the sheet P is nipped in at least two of the three roller pairs.

In the image forming apparatus 100 (the ejection and reverse path 50 in particular) according to the present embodiment, as illustrated in FIG. 4B, the sheet ejection path 55 is opened as the rear cover 51 is opened.

In the present embodiment, to reliably convey the sheet that has just exited the fixing device 44 for a long time, the ejection-side relay roller 52*b* and the conveyance relay roller 52*a* are held by the pivotable front guide plate 57. Accordingly, even when the rear cover 51 is opened, the nip pressure of the ejection-side relay nip 52*d* is kept at a pressure capable of conveying the sheet P. Accordingly, the rear cover 51 is opened in a state in which the sheet P in the sheet ejection path 55 is held (nipped) between the conveyance relay roller 52*a* and the ejection-side relay roller 52*b*. Since the conveyance relay roller 52*a* and the ejection-side relay roller 52*b* are disposed on the rear cover 51, the distance between the ejection-side relay nip 52*d* and the fixing nip 44*c* (between the fixing roller 44*a* and the pressure roller 44*b*) increases as the rear cover 51 is rotated to open. At that time, if the nip pressure of the fixing nip 44*c* is too strong, there is a risk that a portion of the sheet P in the sheet ejection path 55 is pulled. More specifically, the portion of the sheet P extending from the fixing nip 44*c* to the ejection-side relay nip 52*d* may be pulled to tear.

In view of the foregoing, in the present embodiment, on the occurrence of sheet jam, the distance between the axis of the pressure roller 44*b* and the axis of the fixing roller 44*a* is increased to reduce the nip pressure of the fixing nip 44*c* to a pressure lower than the nip pressure of the ejection-side relay nip 52*d*. For example, a biasing member to press the pressure roller 44*b* to the fixing roller 44*a* is moved to reduce the force to bias the pressure roller 44*b* to the fixing roller 44*a*.

Specifically, the nip pressure of the fixing nip 44*c* is made weaker than the nip pressure of the ejection-side relay nip 52*d* and weaker than the rigidity (i.e., strength) of the sheet P. With this structure, as the rear cover 51 is rotated to open, the upstream side of the sheet P upstream from the ejection-side relay nip 52*d* in the sheet ejection path 55 in the sheet conveyance direction A is pulled by the nip pressure of the ejection-side relay nip 52*d*, and the portion of the sheet P nipped between the fixing roller 44*a* and the pressure roller 44*b* moves in the sheet conveyance direction A. Then, the trailing end of the sheet P exits the fixing nip 44*c*. This structure inhibits damage to the portion of the sheet P extending from the fixing nip 44*c* to the ejection-side relay nip 52*d* in the sheet ejection path 55. Note that the nip pressure of the ejection-side relay nip 52*d* may be set at a pressure stronger than the nip pressure of the fixing nip 44*c*, instead of reducing the nip pressure of the fixing nip 44*c*.

Additionally, as the rear cover 51 is rotated to open, the distance between the ejection-side relay nip 52*d* and the sheet ejection nip 53*d* (between the ejection roller 53*a* and the ejection roller 53*b*) increases, and a portion of the sheet P extending from the ejection-side relay nip 52*d* to the sheet ejection nip 53*d* is pulled in the sheet ejection path 55. Accordingly, if both of the nip pressure of the ejection-side relay nip 52*d* and the nip pressure of the sheet ejection nip 53*d* are strong, there is a risk that the portion of the sheet P extending from the ejection-side relay nip 52*d* to the sheet ejection nip 53*d* tears. Therefore, in the present embodiment, the nip pressure of the ejection-side relay nip 52*d* is set at a pressure weaker than the nip pressure of the sheet ejection nip 53*d* and weaker than the rigidity (i.e., strength) of the sheet P. With this structure, as the rear cover 51 is rotated to open, the downstream side of the sheet P downstream from the ejection-side relay nip 52*d* in the sheet ejection path 55 in the sheet conveyance direction A is pulled by the nip pressure of the sheet ejection nip 53*d*, and the portion of the sheet P nipped between the conveyance relay roller 52*a* and the ejection-side relay roller 52*b* moves in the sheet conveyance direction A. Then, the trailing end of the sheet P exits the ejection-side relay nip 52*d*. This structure inhibits damage to the portion of the sheet P extending from the ejection-side relay nip 52*d* to the sheet ejection nip 53*d* in the sheet ejection path 55.

In the present embodiment, when 44*c*P represents the nip pressure of the fixing nip 44*c*, 52*d*P represents the nip pressure of the ejection-side relay nip 52*d*, and 53*d*P represents the nip pressure of the sheet ejection nip 53*d*, a relation defined as 44*c*P<52*d*P<53*d*P is satisfied. Accordingly, when the rear cover 51 is fully open, as illustrated in FIG. 4B, the sheet P in the sheet ejection path 55 is exposed with the leading side in the sheet conveyance direction A nipped between the ejection roller 53*a* and the ejection roller 53*b*. The sheet P in the sheet ejection path 55 can be removed easily as indicated by arrow C.

Although the sheet P in the sheet ejection path 55 exits the ejection-side relay nip 52*d* when the rear cover 51 is fully open, while the rear cover 51 is in a process of opening until the full-open state, the sheet P is kept nipped between the conveyance relay roller 52*a* and the ejection-side relay roller 52*b*. Since the conveyance relay roller 52*a* and the ejection-side relay roller 52*b* are disposed on the rear cover 51 as described above, the position of the ejection-side relay nip 52*d* changes from moment to moment, as the rear cover 51 rotates to open. Accordingly, the curved state of the sheet P in the sheet ejection path 55 changes from moment to moment. In the present embodiment, the conveyance relay roller 52*a* and the ejection-side relay roller 52*b* are held by the pivotable front guide plate 57 that is pivotable relative to the rear cover 51. Accordingly, the pivotable front guide plate 57 pivots corresponding to the curved state of the sheet P in the sheet ejection path 55 so that the direction in which the sheet P exits the ejection-side relay nip 52*d* changes corresponding to the curved state. With this structure, even when the rear cover 51 is rotated to open in the state in which the sheet P is held (nipped) by the conveyance relay roller 52*a* and the ejection-side relay roller 52*b*, the curved state of the sheet P can be changed smoothly, and the load on the sheet P can be suppressed.

Figure 5A:
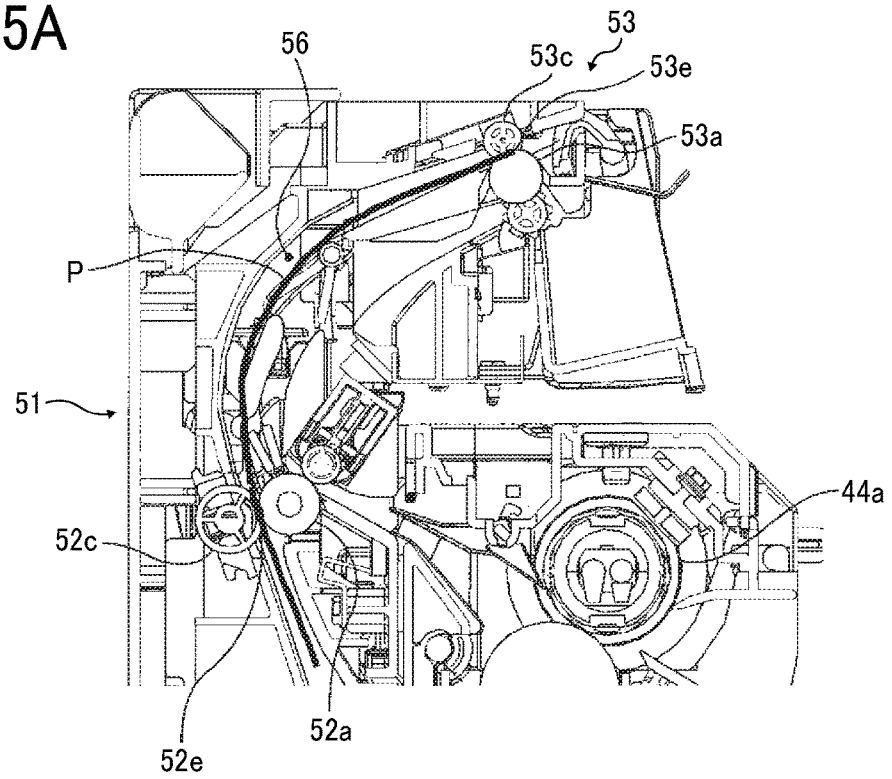
FIG. 5A is a cross-sectional view of the ejection and reverse path illustrated in FIG. 3A, with a sheet jammed in a sheet reverse path.
Figure 5B:
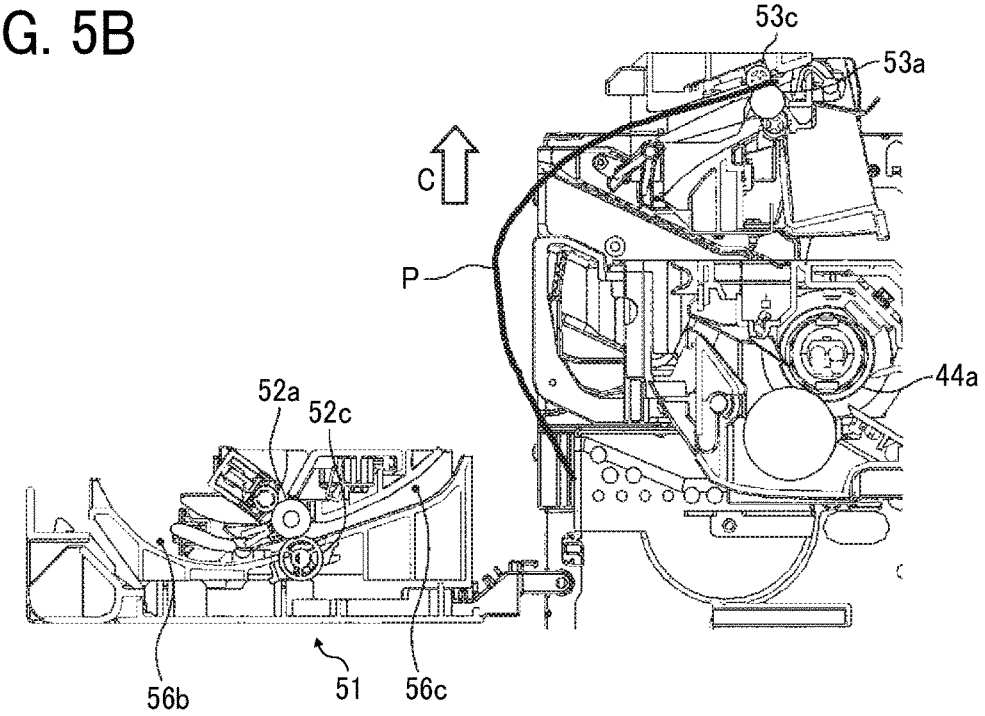
FIG. 5B is a cross-sectional view of the ejection and reverse path illustrated in FIG. 5A, in a state in which the rear cover is closed.

FIGS. 5A and 5B are cross-sectional views of the ejection and reverse path 50, indicating the positions of sheet jam in reversing the sheet P. FIG. 5A illustrates a state in which the rear cover 51 is open. FIG. 5B illustrates a state in which the rear cover 51 is closed.

As illustrated in FIG. 5A, in reversing the sheet P, the sheet P in the sheet reverse path 56 is held between the sheet reverse nip 53*e* (between the ejection roller 53*a* and the reverse roller 53*c* of the ejection and reverse roller section 53) and the reverse relay nip 52*e* between the conveyance relay roller 52*a* and the reverse relay roller 52*c*.

In the image forming apparatus 100 (the ejection and reverse path 50) according to the present embodiment, as illustrated in FIG. 5B, as the rear cover 51 is opened for removal of the jammed sheet P, the pressure of the pivotable front guide plate 57 applied to the rear guide plate 58 is canceled. Consequently, the nip pressure of the reverse relay nip 52*e* is reduced, and the force to hold the sheet P is reduced or canceled. As the rear cover 51 is rotated to open, the sheet P in the sheet reverse path 56 exits the third reverse path 56*c* and the second reverse path 56*b* of the sheet reverse path 56. In the state in which the rear cover 51 is fully open as illustrated in FIG. 5B, the sheet P is exposed with the leading end side held by the ejection roller 53*a* and the reverse roller 53*c*. Accordingly, the sheet P in the sheet reverse path 56 can be removed easily as indicated by arrow C.

Although an embodiment is described above with reference to the drawings, detailed structures according to aspects of this disclosure are not limited to the configurations including the ejection and reverse path 50, but additional modifications and variations are possible in light of the above teachings.

For example, effects similar to those described above can be attained in a structure that includes an ejection roller and a sheet reverse roller separately.

Although the description above concerns the monochrome printer including the ejection and reverse path 50, embodiments according to this disclosure are not limited thereto, and one or more of aspects of this disclosure are applicable to, for example, multicolor image forming apparatuses employing a tandem system.

The structures described above are just examples, and the various aspects of the present disclosure attain respective effects as follows.

Aspect A

Aspect A concerns a sheet conveyance device (e.g., the ejection and reverse path 50) including a conveyance roller (e.g., the fixing roller 44*a*) to convey a sheet, an ejection roller (e.g., the ejection roller 53*a*) to eject the sheet outside the sheet conveyance device, and a conveyance relay roller (e.g., the conveyance relay roller 52*a*) disposed between the conveyance roller and the ejection roller. The sheet conveyance device further includes an openable portion (e.g., the rear cover 51) to open and close relative to a housing of the sheet conveyance device, a pivotable roller holder (e.g., the pivotable front guide plate 57) pivotably attached to the openable portion, and a driven roller (e.g., the ejection-side relay roller 52*b*) to contact the conveyance relay roller to form a nip (e.g., the ejection-side relay nip 52*d*). The pivotable roller holder holds the conveyance relay roller and the driven roller to maintain a nip pressure between the conveyance relay roller and the driven roller when the openable portion is open.

With this aspect, as described in the embodiments, the conveyance relay roller (52*a*) disposed between the conveyance roller (e.g., the fixing roller 44*a*) and the ejection roller is hold by the pivotable roller holder attached to the openable portion. As the openable portion is opened for, e.g., removal of a jammed sheet, the pivotable roller holder, the conveyance relay roller, and the driven roller move from respective home positions (where the pivotable roller holder, the conveyance relay roller, and the driven roller are disposed in a state in which the openable portion is closed). This movement exposes at least the conveyance roller, to which the conveyance relay roller and the driven roller are adjacent, and the entrance and the exit of the sheet conveyance path defined by the pivotable roller holder holding the conveyance relay roller and the driven roller. Such exposing facilitates removal of a sheet jammed in a sheet conveyance path between the conveyance roller and the conveyance relay roller and a sheet jammed between the conveyance relay roller and the ejection roller.

Additionally, the pivotable roller holder holds the conveyance relay roller and the driven roller so that the nip pressure therebetween is maintained when the openable portion is opened. This structure inhibits backlash among the components, thus keeping the nip pressure between the conveyance relay roller and the driven roller (e.g., the ejection-side relay nip 52*d*) constant regardless of elapse of time. Accordingly, the conveyance relay roller and the driven roller can convey the sheet reliably for a long time.

Since the nip pressure between the conveyance relay roller and the driven roller is maintained even when the openable portion is opened, the jammed sheet is kept between the conveyance relay roller and the driven roller while the openable portion is opened or closed. At the initial stage of opening the openable portion, the jammed sheet is nipped between the ejection roller and the roller (e.g., the ejection roller 53*b*) pressing against the ejection roller as well as between the conveyance roller and the roller (e.g., the pressure roller 44*b*) pressing against the conveyance roller. Accordingly, the curved state of the sheet changes as the openable portion is opened with the sheet nipped between the conveyance relay roller and the driven roller. According to Aspect A, the conveyance relay roller and the driven roller are held by the pivotable roller holder to pivot relative to the openable portion. Accordingly, the pivotable roller holder pivots in accordance with the curved state of the sheet, and thus application of load on the jammed sheet is inhibited.

Aspect B

The sheet conveyance device according to Aspect A further includes a second driven roller (e.g., the reverse relay roller 52*c*) held by the openable portion and disposed to contact the conveyance relay roller to form a second nip (e.g., the reverse relay nip 52*e*), wherein the driven roller in Aspect A is referred to as a first driven roller, and the nip between the first driven roller and the conveyance relay roller is referred to as a first nip.

The ejection roller is to rotate in an ejection direction to eject the sheet outside the sheet conveyance device as well as a reverse direction opposite the ejection direction. The conveyance relay roller and the second driven roller nip and convey the sheet conveyed in the reverse direction from the ejection roller.

According to this aspect, as described above, the second driven roller is held by the openable portion. Accordingly, when the openable portion is opened, e.g., for removal of the jammed sheet, the sheet reverse path 56 to convey the sheet in the reverse direction is exposed. Accordingly, the jammed sheet can be easily removed from the sheet reverse path 56.

Aspect C

The sheet conveyance device according to Aspect A further includes a second driven roller (e.g., the reverse relay roller 52*c*) held by the openable portion and disposed to contact the conveyance relay roller to form a second nip (e.g., the reverse relay nip 52*e*).

The nip pressure of the second nip in a state in which the openable portion is open is weaker than the nip pressure of the second nip in a state in which the openable portion is closed.

With this aspect, as described in the embodiments, application of a strong pressure to the jammed sheet can be prevented in removal of the jammed sheet nipped in the second nip in the sheet reverse path.

Aspect D

In Aspect C, the ejection roller is to rotate in the ejection direction to eject the sheet outside the sheet conveyance device as well as the reverse direction opposite the ejection direction. The conveyance relay roller and the second driven roller nip and convey the sheet conveyed in the reverse direction from the ejection roller.

According to this aspect, as described above, the second driven roller is held by the openable portion. Accordingly, when the openable portion is opened, e.g., for removal of the jammed sheet, the sheet reverse path 56, along which the sheet is conveyed in the reverse direction, is exposed. Accordingly, the jammed sheet can be easily removed from the sheet reverse path 56.

Aspect E

The sheet conveyance device according to any one of Aspects A through D further includes an opposing roller (e.g., the ejection roller 53*b*) disposed in contact with the ejection roller to form an ejection nip (e.g., the sheet ejection nip 53*d*). The nip pressure between the conveyance relay roller and the driven roller is weaker than the nip pressure of the ejection nip.

With this aspect, as described in the embodiments, the openable portion is opened with the sheet nipped between the ejection roller and the opposing roller.

Aspect F

A sheet conveyance device (e.g., the ejection and reverse path 50) includes a conveyance roller (e.g., the fixing roller 44*a*) to convey a sheet, an ejection roller (e.g., the ejection roller 53*a*) to eject the sheet, and a conveyance relay roller (e.g., the conveyance relay roller 52*a*) disposed between the conveyance roller and the ejection roller. The sheet conveyance device further includes a driven roller (e.g., the ejection-side relay roller 52*b*) to contact the conveyance relay roller to form a nip (e.g., the ejection-side relay nip 52*d*), and an opposing roller (e.g., the ejection roller 53*b*) disposed in contact with the ejection roller to form an ejection nip (e.g., the sheet ejection nip 53*d*). The nip pressure of the first nip is weaker than the nip pressure of the ejection nip.

As described in the embodiments, this aspect facilitates removal of the jammed sheet.

Aspect G

An image forming apparatus includes a sheet conveyance device, such as the ejection and reverse path 50, according to any one of Aspects A through F.

With this configuration, the image forming apparatus can attain effects similar to those attained by any one of aspects A through F.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A sheet conveyance device comprising:

a conveyance roller configured to convey a sheet;

an ejection roller configured to eject the sheet from the sheet conveyance device;

a conveyance relay roller between the conveyance roller and the ejection roller;

a driven roller configured to contact the conveyance relay roller to form a nip;

an openable portion configured to open and close relative to a housing of the sheet conveyance device; and a pivotable roller holder attached to the openable portion, the pivotable roller holder configured to pivot relative to openable portion and configured to hold the conveyance relay roller and the driven roller to maintain a nip pressure between the conveyance relay roller and the driven roller when the openable portion is opened, wherein the driven roller is a first driven roller configured to form a first nip together with the conveyance relay roller, the sheet conveyance device further includes a second driven roller held by the openable portion and configured to contact the conveyance relay roller to form a second nip, the ejection roller is configured to rotate in an ejection direction to eject the sheet outside the sheet conveyance device and a reverse direction opposite the ejection direction, and the conveyance relay roller and the second driven roller are configured to nip and convey the sheet conveyed in the reverse direction from the ejection roller.

2. A sheet conveyance device comprising:

a conveyance roller configured to convey a sheet;

an ejection roller configured to eject the sheet from the sheet conveyance device;

a conveyance relay roller between the conveyance roller and the ejection roller;

a driven roller configured to contact the conveyance relay roller to form a nip;

an openable portion configured to open and close relative to a housing of the sheet conveyance device; and a pivotable roller holder attached to the openable portion, the pivotable roller holder configured to pivot relative to openable portion and configured to hold the conveyance relay roller and the driven roller to maintain a nip pressure between the conveyance relay roller and the driven roller when the openable portion is opened, wherein the driven roller is a first driven roller to form a first nip together with the conveyance relay roller the sheet conveyance device further includes a second driven roller held by the openable portion and configured to contact the conveyance relay roller to form a second nip, and a nip pressure of the second nip is weaker in a state in which the openable portion is open than in a state in which the openable portion is closed.

3. The sheet conveyance device according to claim 2, wherein the ejection roller is configured to rotate in an ejection direction to eject the sheet outside the sheet conveyance device and a reverse direction opposite the ejection direction, and the conveyance relay roller and the second driven roller are configured to nip and convey the sheet conveyed in the reverse direction from the ejection roller.

4. The sheet conveyance device according to claim 1, further comprising:

an opposing roller configured to contact with the ejection roller to form an ejection nip, wherein the nip pressure between the conveyance relay roller and the driven roller is weaker than a nip pressure of the ejection nip.

5. An image forming apparatus comprising:

an image forming device configured to form an image on a sheet; and the sheet conveyance device according to claim 1, configured to convey the sheet.

6. The sheet conveyance device of claim 1, wherein the openable portion is a rear cover of an image forming apparatus, the rear cover including a front guide plate and a rear guide plate with a conveyance path for the sheet therebetween.

7. The sheet conveyance device of claim 6, wherein the front guide plate is configured to pivot when the rear cover is open to change a nip pressure of a second nip associated with the conveyance relay roller.

8. The sheet conveyance device of claim 7, wherein the front guide plate is configured to hold both the driven roller and the conveyance relay roller such that the first nip is maintained when the rear cover is opened.

9. An image forming apparatus comprising:

an image forming device configured to form an image on a sheet; and the sheet conveyance device according to claim 1, configured to convey the sheet.

10. An image forming apparatus comprising:

an image forming device configured to form an image on a sheet; and the sheet conveyance device according to claim 2, configured to convey the sheet.

* * * * *